US005672131A

United States Patent [19]

Osborne et al.

[11] Patent Number: 5,672,131

[45] Date of Patent: Sep. 30, 1997

[54] ELECTRONIC PADDLE GAME

[75] Inventors: Ian Osborne, Gardena; Elliot Rudell, Torrance; Roger Gardner, Lomita, all of Calif.

[73] Assignee: Elliot A. Rudell, Torrance, Calif.

[21] Appl. No.: 771,853

[22] Filed: Dec. 23, 1996

[51] Int. Cl.[6] ..... A63B 49/00

[52] U.S. Cl. ..... 473/527; 473/463; 463/9

[58] Field of Search ..... 473/463, 516, 473/527, 465, 524, 570; 463/9

[56] References Cited

U.S. PATENT DOCUMENTS

| | | | |
|---|---|---|---|
| 4,101,132 | 7/1978 | Conrey et al. | 473/463 |
| 4,207,087 | 6/1980 | Morrison et al. | 463/9 |
| 4,257,594 | 3/1981 | Conrey et al. | 473/463 |
| 4,822,042 | 4/1989 | Landsman | 473/463 |
| 4,870,868 | 10/1989 | Gastgeb et al. | 473/463 |
| 5,031,909 | 7/1991 | Pecker | 473/463 |
| 5,217,222 | 6/1993 | Rudell . | |
| 5,409,213 | 4/1995 | Yeh | 473/527 |

*Primary Examiner*—Mark S. Graham

*Attorney, Agent, or Firm*—Blakely Sokoloff Taylor & Zafman

[57] ABSTRACT

An electronic paddle that requires a player to strike an object with the paddle in a certain sequence. The electronic paddle includes a paddle that contains a game circuit and a speaker. The game circuit is connected to a first pressure sensor located on a first side of the paddle, and a second pressure sensor located on a second side of the paddle. The pressure sensors provide feedback signals to the game circuit when the paddle strikes the object. The game circuit and speaker generate a first sound when the object strikes the first side of the paddle, and a second sound when the object strikes the second side of the paddle. To play a game the player strikes the object with the first and second sides of the paddle in a pattern that is compared by the game circuit with a predetermined sequence. The game circuit and speaker can emit one sound to indicate a successful matching of the sequence, or another sound to indicate that the player did not strike the object in the correct sequence. The sequence can be either generated by the game circuit, or a pre-existing pattern created by another player striking the object with the first and second sides of the paddle.

19 Claims, 6 Drawing Sheets

ELECTRONIC PADDLE GAME

BACKGROUND OF THE INVENTION

1. Field Of The Invention

The present invention relates to an electronic paddle game.

2. Description Of Related Art

There have been developed a number of toy paddle games. U.S. Pat. No. 5,217,222 issued to Rudell et al. ("Rudell") discloses a paddle game that was marketed by Cadaco. The Rudell paddle included a tympanum membrane that was stretched taught across a paddle frame. The tympanum would emit a loud sound each time the membrane struck an object such as a ball. There has also been marketed toy paddles which electronically emit a sound when the paddle strikes an object. Although amusing, these paddles do not require any particular skill other than merely striking the ball.

There have been developed toys which require a player to correctly simulate a sequence to win the game. For example, Tiger Electronics marketed a game under the trademark LIGHTS OUT which required a player to depress a number of buttons in a correct sequence to win the game. Milton Bradley marketed a game under the trademark SIMON which required a player to depress a plurality of illuminated buttons in a sequence established by internal electronic circuits of the game. It would be desirable to provide a game which would require the player to bounce an object with a paddle in a certain sequence to win the game.

SUMMARY OF THE INVENTION

The present invention is an electronic paddle that requires a player to strike an object with the paddle in a certain sequence. The electronic paddle includes a paddle that contains a game circuit and a speaker. The game circuit is connected to a first pressure sensor located on a first side of the paddle, and a second pressure sensor located on a second side of the paddle. The pressure sensors provide feedback signals to the game circuit when the paddle strikes the object. The game circuit and speaker generate a first sound when the object strikes the first side of the paddle, and a second sound when the object strikes the second side of the paddle. To play a game the player strikes the object with the first and second sides of the paddle in a pattern that is compared by the game circuit with a predetermined sequence. The game circuit and speaker can emit one sound to indicate a successful matching of the sequence, or another sound to indicate that the player did not strike the object in the correct sequence. The sequence can be either generated by the game circuit, or a pre-existing pattern created by another player striking the object with the first and second sides of the paddle.

DETAILED DESCRIPTION OF THE INVENTION

Figure 1:
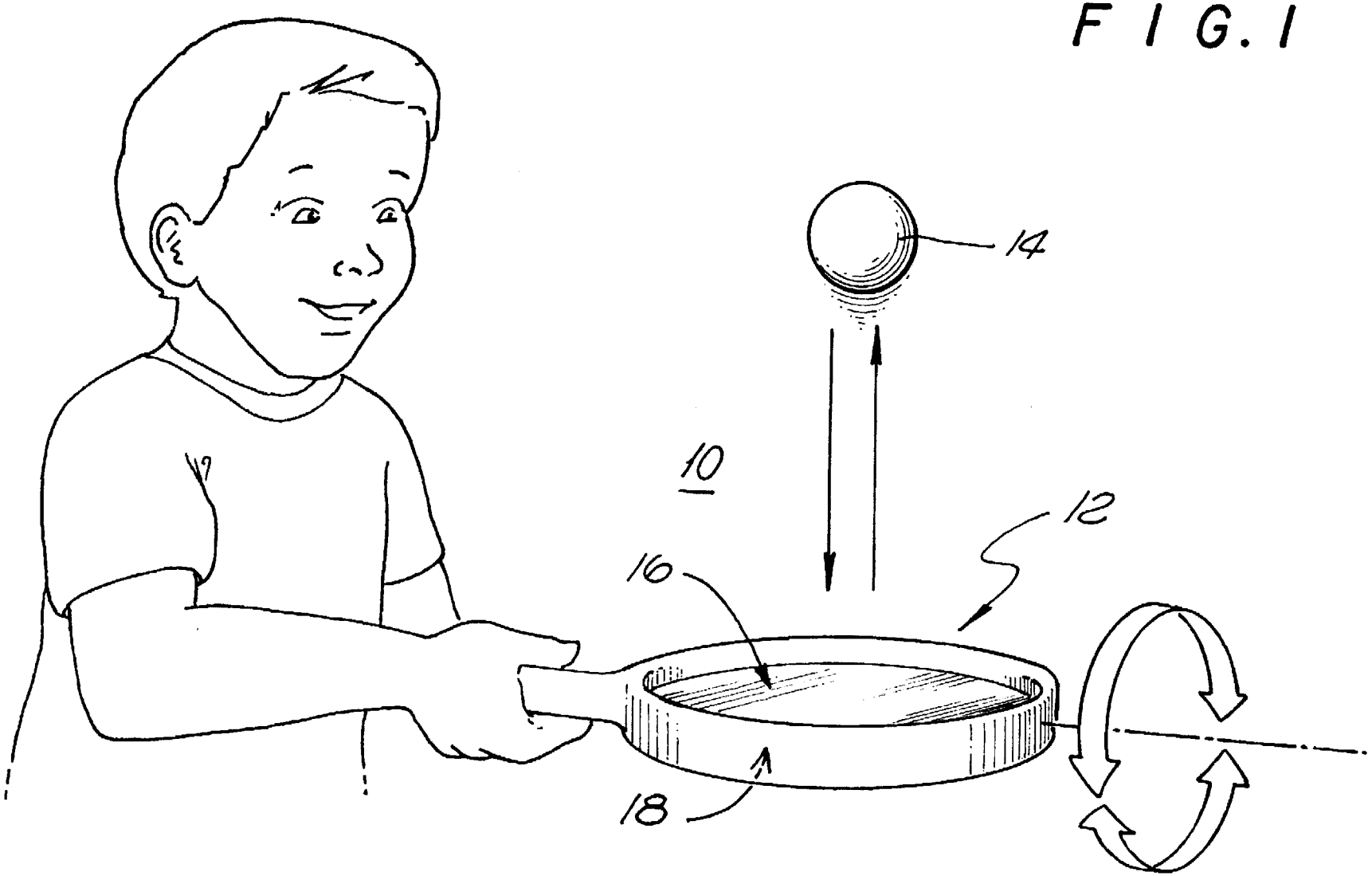
FIG. 1 is a perspective view showing a paddle game of the present invention.

Referring to the drawings more particularly by reference numbers, FIG. 1 shows a paddle game 10 of the present invention. The game 10 includes a paddle 12 that can strike an object 14. The object 14 is preferably a ball that can be bounced from either a first side 16 or a second side 18 of the paddle 12. To win the game the player must strike the object 14 with the first 16 and second 18 sides of the paddle in a certain sequence. The sequence can be generated by either electronics within the paddle 12, or by a pattern created by a player.

Figure 2:
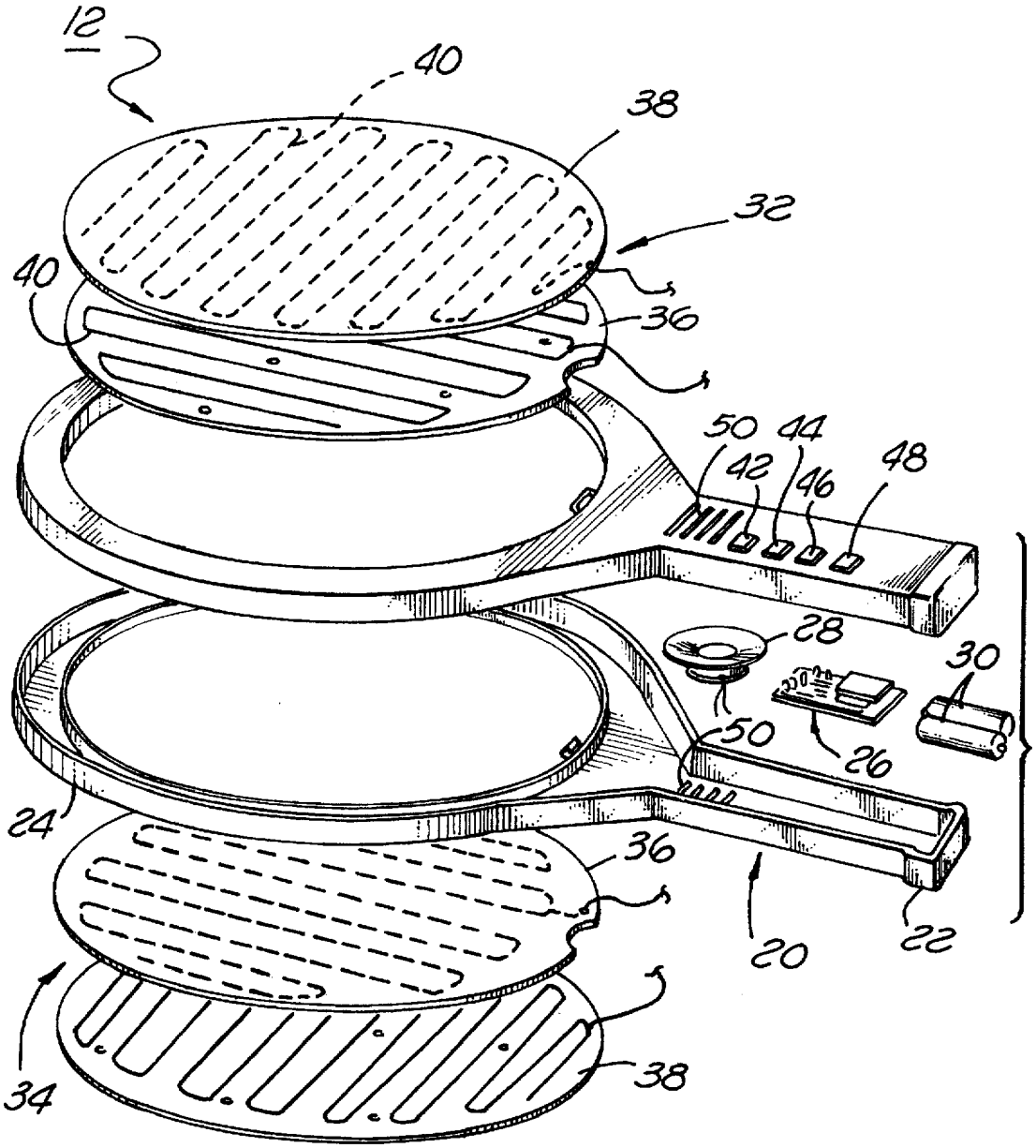
FIG. 2 is an exploded view of a paddle.

FIG. 2 shows a preferred embodiment of the paddle 12. The paddle 12 includes a frame 20 which has a handle portion 22 and a rim portion 24. The frame 20 is preferably constructed from two separate molded plastic pieces that are attached together. The handle portion 22 may contain a game circuit assembly 26 that is connected to a speaker 28 and batteries 30.

Attached to the rim portion 24 of the paddle frame 20 is a first pressure sensor 32, and a second pressure sensor 34 that provide feedback signals to the game circuit 26 when the object 14 strikes the first 16 or second 18 side of the paddle 12. In the preferred embodiment, each pressure sensor includes an inner printed circuit board 36 and an outer printed circuit board 38 that each have conducted traces 40 etched therein. The traces 40 of the circuit boards 36 and 38 function as a switch that is closed when the object 14 strikes a sensor and pushes the outer board 38 into the inner board 36. Contact between the traces 40 of the boards 36 and 38 provide feedback signals to the game circuit 26.

Located on the outer surface of the handle portion 22 are a plurality of function buttons 42, 44, 46 and 48 which provide input signals to the game circuit 26. Each side of the paddle frame 20 may also have light emitting diodes (LED) 50 that are illuminated by output signals from the game circuit 26.

Figure 3:
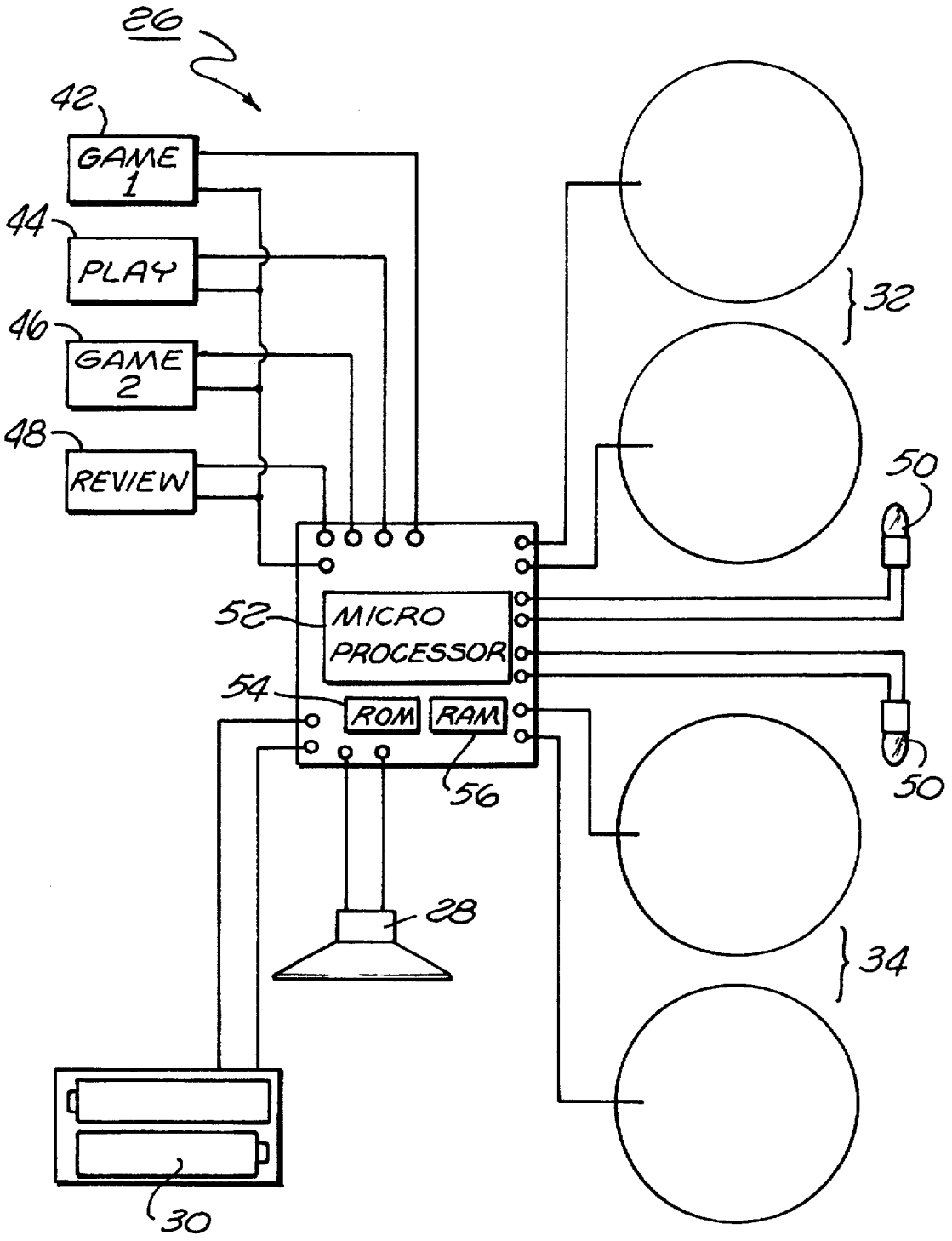
FIG. 3 is a schematic of a game circuit of the paddle.

As shown in FIG. 3 the game circuit 26 may include a microprocessor 52 which is connected to the switches 42, 44, 46 and 48, pressure sensors 32 and 34, LEDs 50, speaker 28 and batteries 30. The circuit 26 may also include a read only memory (ROM) device 54 and a volatile random access memory (RAM) device 56 for storing instructions and data as is known in the art. The game circuit 26 may also have other circuitry such as a digital to analog (D/A) converter and amplifiers (not shown) to drive the speaker 28. The game circuit 26 and speaker 28 are capable of emitting a first sound that is generated each time the object 14 strikes the first pressure sensor 32, and a second sound that is generated each time the object 14 strikes the second pressure sensor 34. By way of example, the first sound may be a beep and the second sound may be a boop. The circuit 26 may also illuminate the LEDs 50 to correspond with the object 14 striking the first 16 or second 18 sides.

The pressure sensors 32 and 34, and switches 42, 44, 46 and 48 are connected to input pins of the processor 52. The speaker 28 and LEDs 50 are connected to output pins of the processor 52. The processor 52 operates in accordance with a set of instructions to compare a pattern of the feedback signals provided by the sensors 32 and 34 with a certain sequence. If the pattern does not match the sequence the game circuit 26 and speaker 28 may generate a third sound. If the pattern does match the sequence the game circuit 26 and speaker 28 may generate a different fourth sound.

Figure 4A:
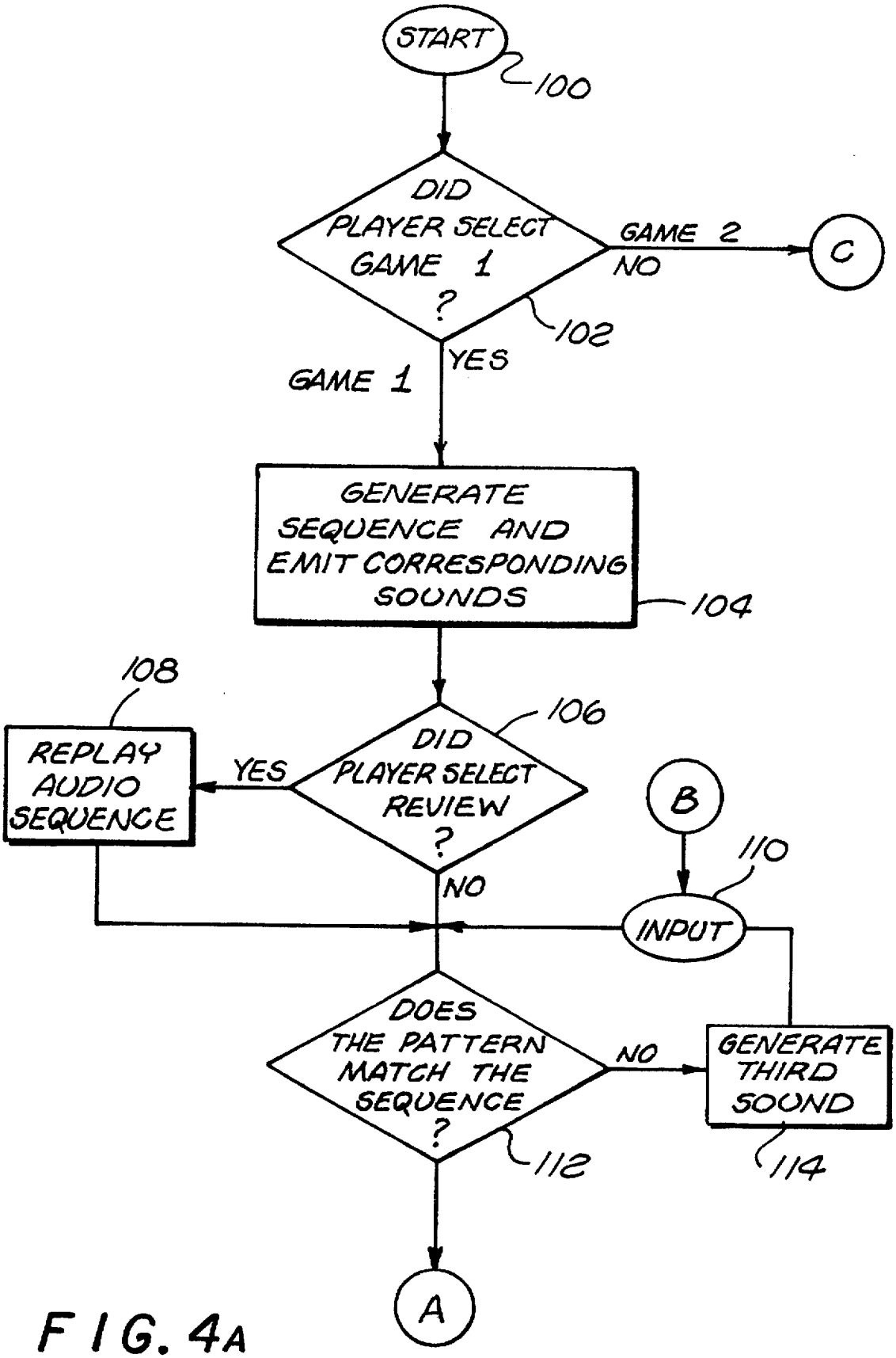
FIGS. 4*a–c* show a flowchart of the paddle game.
Figure 4B:
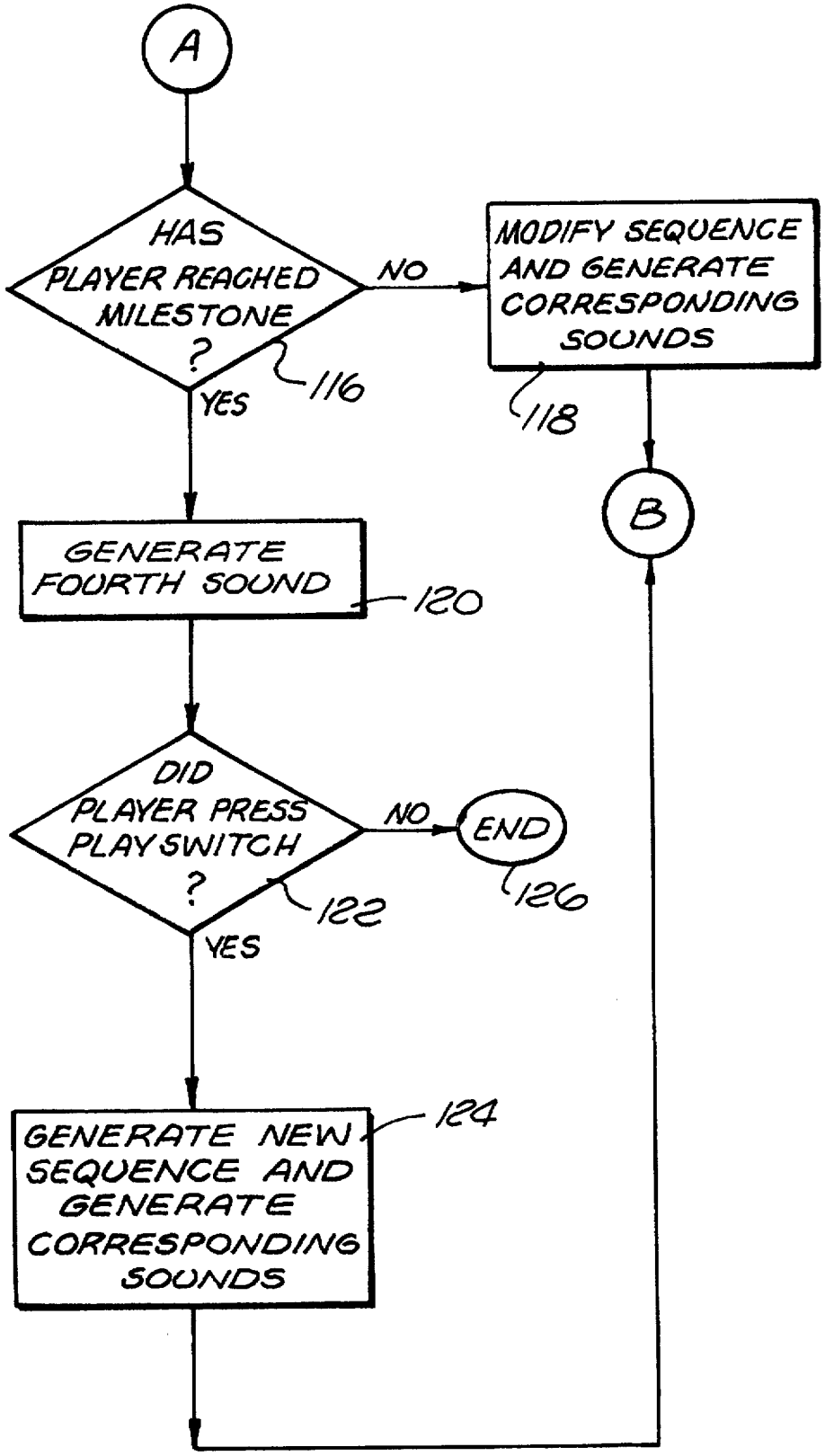
Figure 4C:
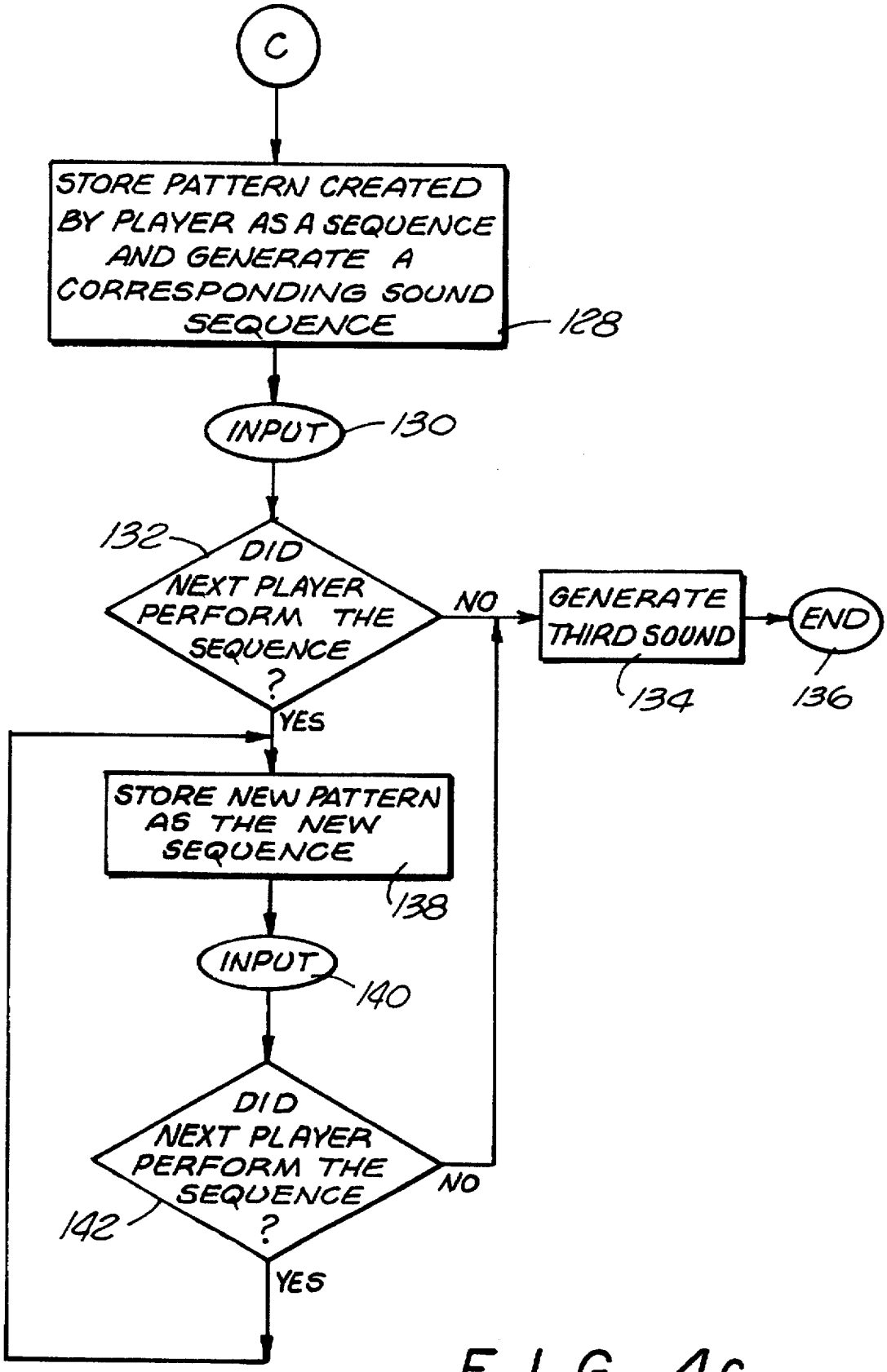

The operation of the paddle game and program of the processor 52 is shown in the flowchart of FIGS. 4A–C. A player starts the game in start block 100 by selecting either the Game 1 switch 42 or the Game 2 switch 46 in decision block 102. If the player selected Game 1 the processor 52 generates a sequence and drives the speaker 28 to emit a corresponding sequence of sounds in block 104. By way of example, the sequence may be to strike the first side, the second side and then the first side of the paddle with the object. The game circuit 26 and speaker 28 then generate the sound sequence "beep, boop, beep". The circuit 26 and speaker 28 replay the sequence if the player depresses the Review switch 48 in decision block 106 and processing block 108.

The player must then strike the object 14 with the first side 16, the second side 18 and then the first side 16 in the input block 110. In decision block 112, the microprocessor 52 compares the pattern created by the player with the sequence generated by the processor 52. If the pattern does not match the sequence the game circuit 26 and speaker 28 generate the third sound in block 114 and the process returns to block 110.

If the pattern does match the sequence the circuit 26 will determine whether a milestone has been reached in decision block 116. By way of example, a milestone may be reached when the player has successfully matched a sequence which has 5 separate sounds. If the milestone has not been reached the processor 52 may generate a new sequence by adding an additional sound in block 118 and return to the input 110. The player then attempts to duplicate the new sequence. This process is repeated until the milestone is reached wherein the circuit 26 and speaker 28 generate the fourth sound indicative of a successful round of the game in block 120.

The player can continue playing the game by depressing the Play switch 44 in decision block 122, wherein the process proceeds to block 124 to generate a new sequence and the routine is repeated. If the player does not depress the Play switch 44 the game ends at block 126. The process may have an internal count routine which automatically generates the third sound if the player does not strike the object 14 with the paddle 12 within a certain time interval. Additionally, the internal count routine may automatically turn the paddle off if the player does not strike the object 14 with the paddle within a second longer interval. The Review loop shown in blocks 106 and 108 may occur at different portions of the process.

Returning to decision block 102, initially depressing the GAME 2 switch 46 allows the players to create the sequence. In block 128 the game circuit 26 receives and stores a pattern created by a player striking the object 14 with the first 16 and second 18 sides of the paddle 12. By way of example, if the player strikes the object 14 with the first side 16 and the second side 18, the processor 52 and memory 56 will store this pattern as the sequence. The paddle also generates an associated sound pattern so that another player can hear the sequence.

The next player must then strike the object in the same pattern as the sequence created by the previous player at input 130. If the player does not successfully match the sequence the circuit 26 and speaker 28 generate the third sound and end the game in processing blocks 132, 134 and 136. If the pattern matches the sequence the next player provides an additional bounce to create a new pattern which is stored as the new sequence in block 138. The paddle is then passed to another player which must duplicate the new sequence at blocks 140 and 142. If successful the player provides an additional bounce to create yet another pattern which is stored by the game circuit. This process is continued until a player is unsuccessful in duplicating a sequence wherein the third sound is generated and the game ends. The review of sequence and count intervals described above can also be implemented in this version of the game.

While certain exemplary embodiments have been described and shown in the accompanying drawings, it is to be understood that such embodiments are merely illustrative of and not restrictive on the broad invention, and that this invention not be limited to the specific constructions and arrangements shown and described, since various other modifications may occur to those ordinarily skilled in the art.

By way of example, instead of providing pressure sensors on both sides of the paddle, one, or both, sides may have a number of discrete sensors. Each sensor would have an associated sound that is generated by the game circuit and the speaker. A player must then successfully strike the object within certain areas of a paddle to follow a sequence.

What is claimed is:

1. A toy paddle that can be manipulated to strike an object, comprising:

a paddle;

a first pressure sensor that senses when the object strikes said paddle;

a second pressure sensor that senses when the object strikes said paddle;

a game circuit that is coupled to said first and second pressure sensors, and which compares a pattern of the object striking said paddle with a sequence and provides an output signal when said pattern does not match said sequence; and, an indicator that is activated by said output signal of said game circuit.

2. The toy paddle as recited in claim 1, wherein said sequence is generated by said game circuit.

3. The toy paddle as recited in claim 1, wherein said sequence is generated by a predetermined pattern of the object striking said paddle by a player.

4. The toy paddle as recited in claim 1, wherein said first pressure sensor is located on a first side of said paddle and said second pressure sensor is located on a second side of said paddle.

5. The toy paddle as recited in claim 4, wherein said indicator includes a speaker which emits a first sound when the object strikes said first side and a second sound when the object strikes said second side.

6. The toy paddle as recited in claim 4, wherein said indicator includes a first light source which emits light when the object strikes said first side and a second light source which emits light when the object strikes said second side.

7. The toy paddle as recited in claim 4, wherein said first and second pressure sensors each include an inner printed circuit board that is electrically connected to an outer printed circuit board when the object strikes said paddle.

8. The toy paddle as recited in claim 1, further comprising a plurality of function buttons that are attached to said paddle and connected to said game circuit.

9. A toy paddle that can be manipulated to strike an object, comprising:

a paddle which has a first side and an opposite second side;

a first pressure sensor which senses when the object strikes said first side of said paddle;

a second pressure sensor which senses when the object strikes said second side of said paddle;

a game circuit that is coupled to said first and second pressure sensors and which compares a pattern of the object striking said paddle with a sequence and provides an output signal when said pattern does not match said sequence, wherein said sequence is either generated by said game circuit or a predetermined pattern;

a speaker that emits a first sound when the object strikes said first side, a second sound when the object strikes said second side, and a third sound when said game circuit generates said output signal;

a first function button that is attached to said paddle and which enables said generation of said sequence by said game circuit; and, a second function button that is attached to said paddle and which enable said sequence as said predetermined pattern.

10. The toy paddle as recited in claim 9, further comprising a first light source which emits light when the object strikes said first side and a second light source which emits light when the object strikes said second side.

11. The toy paddle as recited in claim 10, wherein said first and second pressure sensors each include an inner printed circuit board that is electrically connected to an outer printed circuit board when the object strikes said paddle.

12. A toy paddle that can be manipulated to strike an object, comprising:

a paddle;

a first pressure sensor that senses when the object strikes said paddle;

a second pressure sensor that senses when the object strikes said paddle;

a game circuit that is coupled to said first and second pressure sensors, and which compares a pattern of the object striking said paddle with a sequence and provides an output signal when said pattern matches said sequence; and, an indicator that is activated by said output signal of said game circuit.

13. The toy paddle as recited in claim 12, wherein said sequence is generated by said game circuit.

14. The toy paddle as recited in claim 12, wherein said sequence is generated by a predetermined pattern of the object striking said paddle by a player.

15. The toy paddle as recited in claim 12, wherein said first pressure sensor is located on a first side of said paddle and said second pressure sensor is located on a second side of said paddle.

16. The toy paddle as recited in claim 15, wherein said indicator includes a speaker which emits a first sound when the object strikes said first side and a second sound when the object strikes said second side.

17. The toy paddle as recited in claim 15, wherein said indicator includes a first light source which emits light when the object strikes said first side and a second light source which emits light when the object strikes said second side.

18. The toy paddle as recited in claim 15, wherein said first and second pressure sensors each include an inner printed circuit board that is electrically connected to an outer printed circuit board when the object strikes said paddle.

19. The toy paddle as recited in claim 12, further comprising a plurality of function buttons that are attached to said paddle and connected to said game circuit.

* * * * *